United States Patent [19]

Kather et al.

[11] 4,078,666

[45] Mar. 14, 1978

[54] SUPPLEMENTARY JIB FOR A FLOATING CRANE HAVING A DERRICKING MAIN JIB

[75] Inventors: Hans Kather, Preetz; Gerhard Kühl, Altenholz-Stift; Peter Stelck, Klausdorf, all of Germany

[73] Assignee: Howaldtswerke-Deutsche Werft Aktiengesellschaft Hamburg und Kiel, Kiel, Germany

[21] Appl. No.: 720,171

[22] Filed: Sep. 2, 1976

[30] Foreign Application Priority Data

Sep. 5, 1975 Germany ..... 2539527

[51] Int. Cl.[2] ..... B66C 23/52

[52] U.S. Cl. ..... 212/3 R; 212/144

[58] Field of Search ..... 212/3 R, 8 R, 35 R, 212/58 R, 54, 144

[56] References Cited

U.S. PATENT DOCUMENTS 3,828,938 8/1974 Glushko et al. ..... 212/3 R

FOREIGN PATENT DOCUMENTS 642,459 5/1964 Belgium ..... 212/3

326,842 1/1935 Italy ..... 212/3

*Primary Examiner*—Drayton E. Hoffman

*Assistant Examiner*—R. B. Johnson

*Attorney, Agent, or Firm*—John C. Smith, Jr.

[57] ABSTRACT

A supplementary jib for a floating crane having a derricking main jib is characterized in that the hinge (bearing) of the supplementary jib is located in proximity or coincides with the hinge of the main jib. The main jib is incorporated in the crane system by virtue of compression struts and guy ropes meeting at the head of the main jib.

2 Claims, 3 Drawing Figures

SUPPLEMENTARY JIB FOR A FLOATING CRANE HAVING A DERRICKING MAIN JIB

BACKGROUND OF THE INVENTION

This invention relates generally to floating cranes with a derricking jib and concerns more specifically the provision of an auxiliary jib in such a crane.

In conventional floating cranes with a derricking jib it is the practice for the purpose of increasing outreach and luffing height to fit a supplementary top mounting jib. Top mounting jibs are mounted on laterally projecting hinge pins at the top or head of the main jib. In the case of hitherto conventional top mounting jibs which are about 20 meters in length the crane is capable of picking up the supplementary jib from the horizontal without assistance. If the top mounting jib is of greater length, external assistance is needed to lift the additional weight.

For the assembly of special constructions, such as offshore rigs, great luffing heights and load lifting capacities are required. These requirements cannot be satisfactorily met by conventional supplementary jibs mounted at the top of the main jib. The lengths of rope on the derrick winch needed for erecting such systems would far exceed the rope lengths needed for luffing the loads. Moreover, the design weight of the main jib for taking up the greater loads would also have to be higher.

SUMMARY OF THE INVENTION

The invention proposes to shift the hinge of the supplementary jib and to include the main jib in the new crane system. The hinge of the supplementary jib is transferred from the top of the main jib into proximity with the hinge of the main jib. In the ideal case both hinges would coincide. Compression struts and guy ropes meet at the head of the main jib. When taking up the supplementary jib the main jib functions as an erecting boom. In view of the favorable lever ratio for the luffing rope the length of rope needed for erecting the system will not exceed that needed for luffing the load. This is a major factor in making the system economical.

BRIEF DESCRIPTION OF THE DRAWING

An embodiment of the invention will now be described by way of example and with reference to the accompanying drawing, in which.

DESCRIPTION OF THE PREFERRED EMBODIMENT

Figure 1:
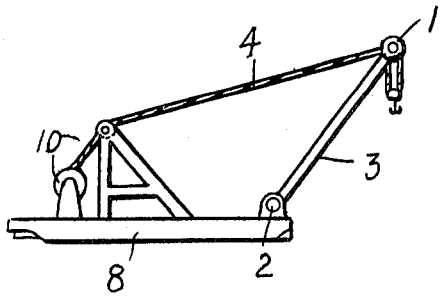
FIG. 1 is a side elevation of a floating crane.

FIG. 1 shows a floating crane 8 which comprises a derricking main jib 3 and a luffing rope 4. The head of the main jib 3 is at 1, whereas 2 is a hinge connecting the foot of the main jib 3 to the pontoon of the floating crane 8.

Figure 3:
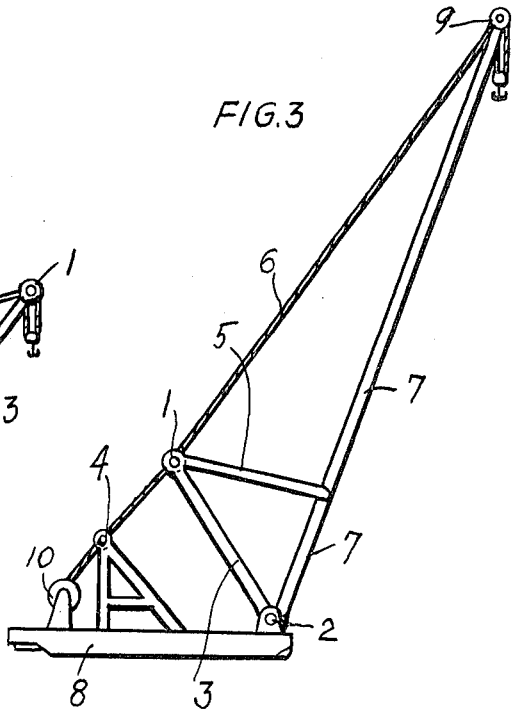
FIG. 3 is a side elevation of the erected supplementary jib.
Figure 2:
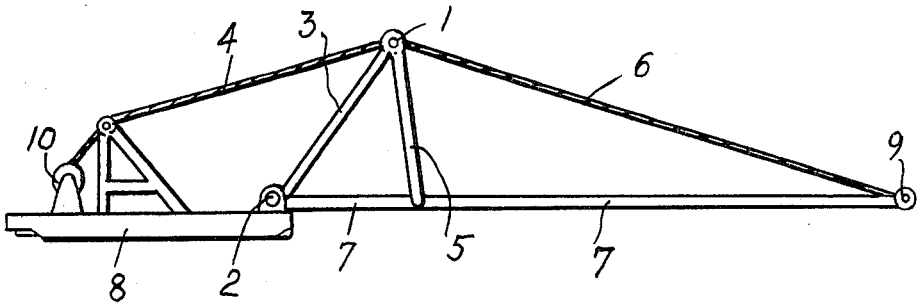
FIG. 2 is a side elevation showing a supplementary jib attached to the main jib.

FIGS. 2 and 3 show a supplementary jib attached to the main jib 3. The supplementary jib comprises supplementary jib sections 7 and a compression strut 5 to the top of which guy ropes 6 are fastened and connected to the supplementary jib sections 7.

The manner in which the supplementary jib is picked up is as follows:

The supplementary jib is assembled on land or on pontoons. The supplementary jib sections 7 are laid out and the guy ropes 6 are fastened to the upper end of the compression strut 5 and to the supplementary sections 7 at 9. The floating crane 8 is now manoeuvred into position so that the supplementary jib 7 can be mounted in its bearings. The compression strut 5 with the guy ropes 6 attached is erected and connected to the top of the main jib 1. The entire jib system can then be erected by means of the luffing rope 4 and a derrick winch 10.

The invention may be embodied in other specific forms without departing from the spirit or essential characteristics thereof. The embodiment is therefore to be considered in all respects as illustrative and not restrictive.

What is claimed is:

1. An auxiliary jib structure for increasing the luffing height and load lifting capacity of an existing crane comprising a base, a main jib of predetermined length, means pivotally mounting one end of said main jib on said base, winch means and cable means extending from the end of said main jib opposite said one end thereof to said winch means; said auxiliary jib structure comprising a supplementary jib having a length greater than said predetermined length of said main jib, a compression strut extending transversely from a position intermediate the ends of said supplementary jib, one end of said supplementary jib being adapted to be pivotally mounted on said base adjacent said means pivotally mounting said main jib, the end of said compression strut opposite said supplementary jib being adapted to be secured to said opposite end of said main jib and further cable means extending from the end of said supplementary jib opposite said one end thereof to said opposite end of said compression strut.

2. An auxiliary jib structure as defined in claim 1 wherein said supplementary jib comprises at least two elongated sections joined end-to-end, said compression strut extending from said supplementary jib where said sections are joined.

* * * * *